United States Patent [19]

Altherr

[11] Patent Number: 4,593,829

[45] **Date of Patent: * Jun. 10, 1986**

[54] ARTICULATED RAILWAY CAR CONNECTION WITH GUIDED SLACK ADJUSTING WEDGES

[75] Inventor: Russell G. Altherr, Munster, Ind.

[73] Assignee: AMSTED Industries Incorporated, Chicago, Ill.

[ * ] Notice: The portion of the term of this patent subsequent to Jun. 10, 2003 has been disclaimed.

[21] Appl. No.: 561,874

[22] Filed: Dec. 15, 1983

[51] Int. Cl.[4] ..... B61G 1/28; B61G 5/02

[52] U.S. Cl. ..... 213/75 R; 105/4 R; 213/188

[58] Field of Search ..... 213/64, 75 R, 69, 67 R, 213/188, 62 R, 62 A, 72; 105/3, 4 R, 207; 308/244; 384/267, 268, 269

[56] References Cited

U.S. PATENT DOCUMENTS

| | | | |
|---|---|---|---|
| 260,345 | 6/1882 | Zastrow | 384/267 |
| 3,716,146 | 2/1973 | Altherr | 213/64 |
| 3,717,106 | 2/1973 | Henricot | 105/207 |
| 4,336,758 | 6/1982 | Radwill | 105/4 R |
| 4,456,133 | 6/1984 | Altherr et al. | 213/69 |

*Primary Examiner*—Randolph A. Reese
*Assistant Examiner*—Dennis C. Rodgers
*Attorney, Agent, or Firm*—Charles E. Bouton; Edward J. Brosius

[57] ABSTRACT

The present invention relates to articulated railway coupler connections. The butt end of the male articulating connection contacts a follower block which in turn contacts a wedge shaped shim. Such shim provides an essentially slackless feature to the coupling connection. Further, surfaces of the follower block and the shim or of the shim and the rear cavity wall are modified such that alignment of the shim within the cavity is assured despite any angling or slight rotation of the male connection member.

2 Claims, 7 Drawing Figures

ARTICULATED RAILWAY CAR CONNECTION WITH GUIDED SLACK ADJUSTING WEDGES

BACKGROUND OF THE INVENTION

The present invention relates to railway car coupling arrangements and, more particularly, to articulated connections with slack adjusting wedges.

With the higher loads carried by modern railway trains, it is important to maintain close butted relationships between coupler draft components to lessen impact forces under buff conditions. Since most articulated connection parts are cast with little or no finish machining to provide dimensional control, it is desirable to provide a coupling device which is self adjusting under various wear conditions to lessen the slack in such connections. One type of self adjusting articulated connection is shown in U.S. Pat. No. 3,716,146.

In articulated coupling arrangements, the male connecting member extends into the female connecting member. The butt end of the male member is arcuate convex and abuts a complementary front concave surface of a follower block. The back surface of the follower abuts the front surface of a wedge shim which has a rear surface that abuts the rear wall of a cavity in the female member. Either or both of the front and rear wall of the shim member diverge upwardly to provide the gravity assisted wedging force which makes the coupling arrangement slackless. When the butting surfaces become worn, the shim member drops slightly to maintain the essentially slackless connection.

In the female coupling member in the articulated coupling arrangement, top, bottom and vertically disposed side walls provide a cavity for the follower and the shim. The side walls limit the lateral translation and therefore rotation of the follower about the vertical axis of the arcuate butt end of the male member upon the horizontal angling of the male member. Such rotation of the follower may cause the wedge shim to rotate about the car longitudinal axis and possibly hang up between the vertical walls, especially when the shim is small in height relative to its width. The known method of controlling such rotation of the follower and the relative orientation between the shim and the follower is to provide for a very close tolerance between the vertical side walls of the cavity and the shim and the follower side edges. Due to the cast nature of such components the procedure requires an uneconomical amount of tolerance design and machining of finished parts.

Accordingly, it is an object of the present invention to provide an improved slackless articulated coupling arrangement.

SUMMARY OF THE INVENTION

The present invention provides an improved slackless articulated coupling arrangement. In such coupling arrangements, the male member extends into the female connection. Within the cavity in the female connection are a follower block and a wedge shim. The front surface of the follower block has an arcuate concave section which abuts the arcuate convex end of the male connecting member. The rear surface of the follower block is of a generally convex shape comprising two generally planar surfaces joined at a vertex substantially in the vertical center plane of the car. Each planar surface extends away from a vertical transverse plane at an angle of 0°–20°.

A wedge shim is located between the follower block and the rear wall of the female connection. Either the front wall or the rear wall or both of the walls of the wedge shim are sloped from the vertical to form an upwardly diverging member. The front wall of the shim comprises two generally flat surfaces joined at a vertical center axis. Such surfaces extend from said axis at angles of 0°–20° from a plane through the vertical center axis to form a generally concave surface which is complementary to and abuts the convex surface of the follower block.

In an alternative embodiment of the present invention. the rear wall of the follower block is generally flat as is the front wall of the shim. However, the rear wall of the shim comprises two generally flat surfaces joined at a center vertical axis. Such surfaces extend from said axis at angles of 0°–20° from the horizontal to form a generally convex surface. A complementary concave surface is formed on the rear wall of the female connection.

Other alternative embodiments of the present invention include the follower block-shim interface wherein the follower block rear surface is concave and the complementary front surface of the shim is convex. Another embodiment would include the follower block rear surface being concave and the rear wall of the female connection being convex.

In particular, the present invention provides a coupler arrangement for adjacent ends of railway cars comprising a female member having top, bottom and side walls forming an open cavity therein, said top and bottom walls having vertically aligned holes therein, a male member having an arcuate end surface with a vertical hole near said end, said male member fitting within said cavity, a pin means extending through the vertically aligned holes in the female and the male member thereby pivotally connecting said female and said male members, a pin bearing block located between said pin means and the hole in the male member, a follower block having a front arcuate surface abutting the arcuate end surface of said male member and a rear surface comprising two generally planar surfaces joined along a centrally located vertical axis, said planar surfaces extending from said vertical axis at angles of 0°–20°0 from the horizontal to form a convex arrangement, and a shim member having a sloped rear surface abutting a sloped interior wall of the female member cavity and a front surface comprising two generally planar surfaces joined along a centrally located vertical axis, said planar surfaces extending from said vertical axis at angles of 0°–20°0 from the horizontal to form a concave arrangement.

The present invention further provides an articulated railway coupler arrangement comprising a male member inserted into a female member, a shim member having a sloped rear surface abutting a sloped rear wall of a cavity in said female member and a generally concave front surface comprising two generally planar surfaces joined at a vertical central axis, and a follower block having an arcuate concave front surface abutting the arcuate convex end of said male member and a generally convex rear surface comprising two generally planar surfaces joined at a vertical central axis, said rear surface abutting the front surface of said shim member.

The present invention also provides an articulated railway coupler arrangement comprising a male member inserted into a female member, a shim member having a sloped generally convex rear surface abutting a sloped generally concave rear wall of a cavity in said female member and a generally concave front surface, said shim rear convex surface comprising two generally planar surfaces joined at a vertical center axis, said shim member concave front surface comprising two generally planar surfaces joined at a vertical center axis, said rear concave wall of said female member cavity comprising two generally planar walls joined at a vertical center axis, and a follower block having a generally convex rear surface comprising two generally planar surfaces joined at a vertical center axis abutting the front concave surface of said shim member and an arcuate concave front surface abuttting the arcuate convex end of said male member.

In summary, the present invention relates to the prevention of relative lateral translation between the components of a railway coupler arrangement. In one embodiment, the abutting surfaces of the wedge shim and the follower block are each comprised of two generally planar surfaces joined at a center vertical axis to form a convex surface on the follower block and a concave surface on the wedge shim. Accordingly, relative lateral translation between the shim and the follower is prohibited. In another embodiment, the abutting surfaces of the wedge shim and the rear surface of the side casting pocket are each comprised of two generally planar surfaces joined at a center vertical axis to form a convex surface on the shim and a concave surface on the pocket. Accordingly, relative lateral translation between the shim and the follower is prohibited. In another embodiment, the abutting surfaces of the wedge shim and the follower block and the abutting surfaces of the wedge shim and the rear surface of the side casting pocket are comprised of the concave-convex surfaces described above. Accordingly, relative translation between the shim, the follower and the side casting is prohibited.

DESCRIPTION OF THE PREFERRED EMBODIMENTS

Figure 1:
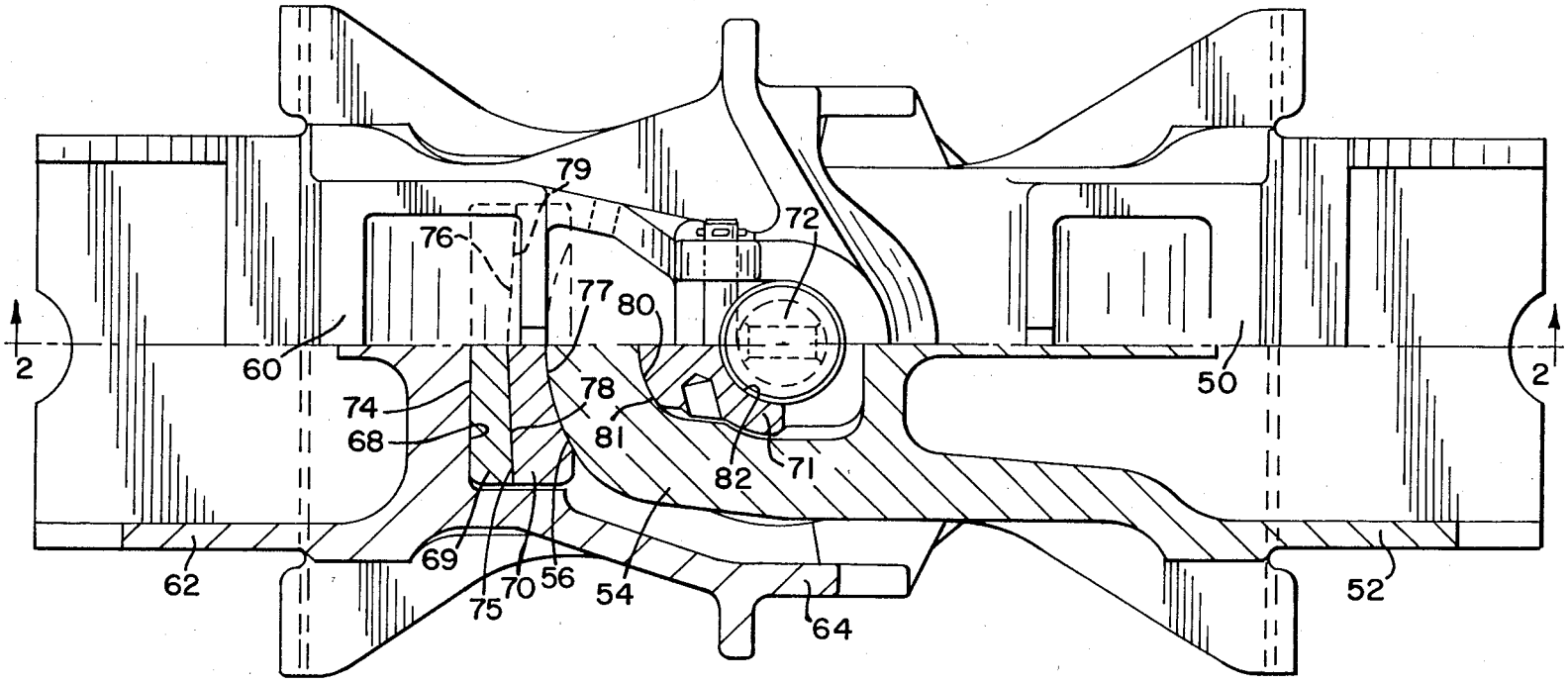
FIG. 1 is a top view in partial cross section of an articulated connection showing the interface of various members of the assembly and particularly the shim-follower block interface and the shim-pocket wall interface.
Figure 2:
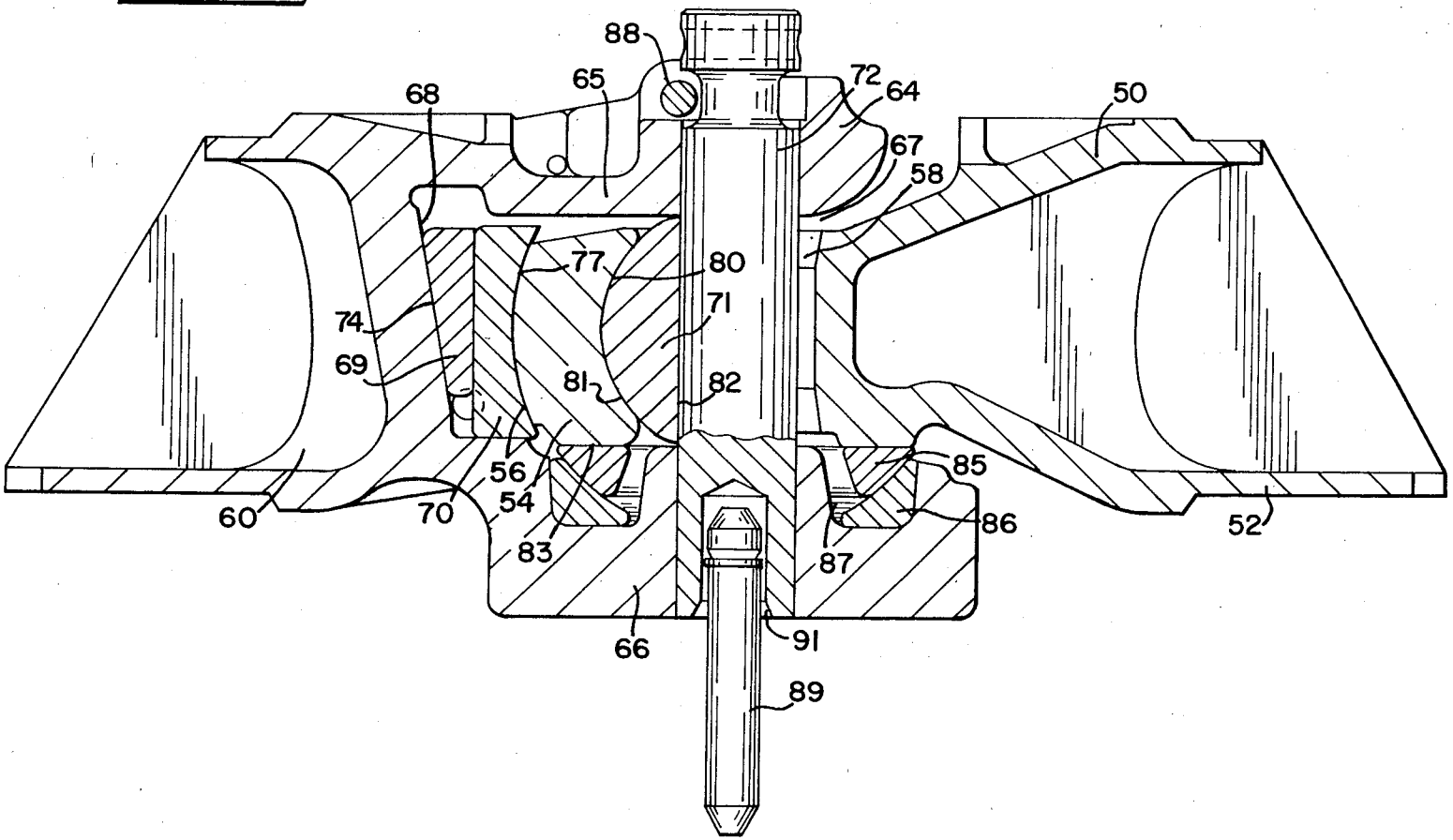
FIG. 2 is a side view in partial cross section of an articulated connection along lines 2—2 of FIG. 1.

Referring now to FIGS. 1 and 2, an articulated railway coupler connection is shown. Male connection member 50 comprises an elongated shank portion 52 and an end or butt portion 54 having an arcuate convex surface 56. A vertical hole 58 is provided through the top and bottom of shank portion 52 near butt portion 54. Female connection member 60 comprises an elongated shank portion 62 and an end portion 64. End portion 64 comprises top wall 65, bottom wall 66 and connecting side walls which combine to form cavity 67. Cavity 67 has a sloped rear wall 68. Abutting rear wall 68 is the sloped rear surface 74 of wedge shim 69 which is located within cavity 67. Shim 69 has planar front surfaces 78 and 79. Also located within cavity 67 is follower block 70 which has planar rear surfaces 75, 76 and arcuate concave front surface 77. Arcuate convex surface 56 of butt section 54 abuts concave front surface 77 of follower 70.

Butt end section 54 of male connecting member 50 has an inner arcuate concave surface 80. A pin bearing block 71 has an outer arcuate convex surface 81 that abuts butt section surface 80, and has an inner arcuate concave surface 82. A cylindrical pin 72 is located within a hole in top wall 65 and bottom wall 66 of female connecting member 60, and passes through vertical hole 58 in male connecting member 50, thereby connecting male and female members 50, 60 in a coupled arrangement. Retaining pin 88 is located within a portion of top wall 65 and partially in a groove in the top of pin 72, and center pin 89 is located in a cavity 91 in the bottom of pin 72.

Butt end section 54 of male connecting member 50 has a generally circular lower surface 83 which rests on a spherical support ring 85. Support ring 85 itself rests on ring seat 86 which is located within a generally circular cavity 87 in bottom wall 66 of female member 60.

Figure 3:
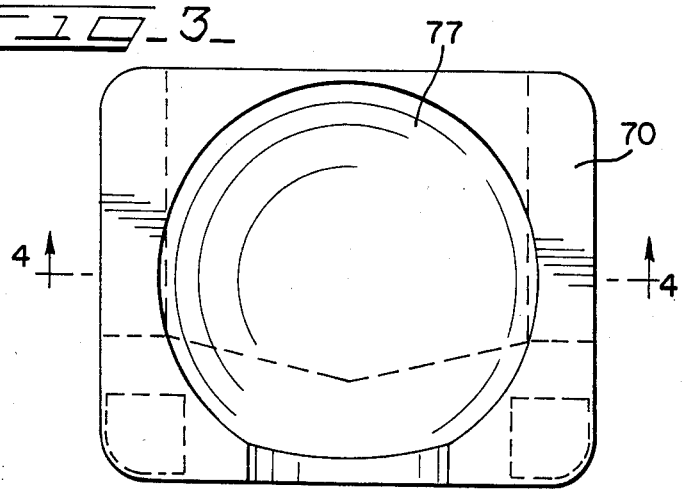
FIG. 3 is a front view of a follower block.
Figure 4:
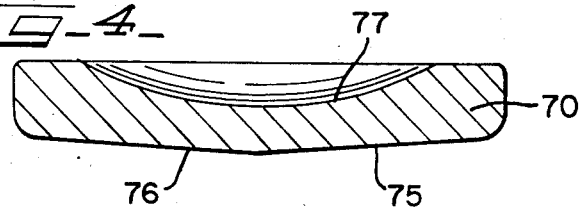
FIG. 4 is a cross section of a follower block along lines 4—4 of FIG. 3.

For a more detailed view of follower block 70 FIGS. 3—4 are now referred to. A front view of the follower block 70 is provided in FIG. 3. Follower block 70 is of a generally rectangular shape, having an arcuate concave surface 77 on the front face. In FIG. 4, a cross section of the follower block 70 is shown. Generally flat surfaces 75 and 76 comprise each half of the rear face of the follower block 70. Such faces are joined at a center vertical axis at an angle of from 140°–180° to form a convex face of follower block 70. Alternatively, this arrangement could be described by stating that surfaces 75 and 76 each extend at an angle between 0° and 20° from a transverse plane containing said center axis.

Figure 6:
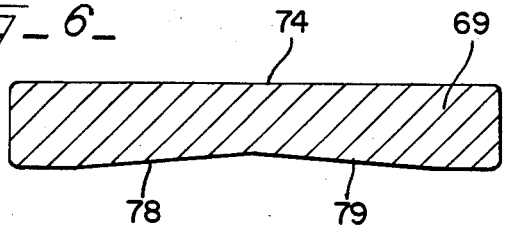
FIG. 6 is a cross section of a wedge shim along lines 6—6 of FIG. 5.
Figure 5:
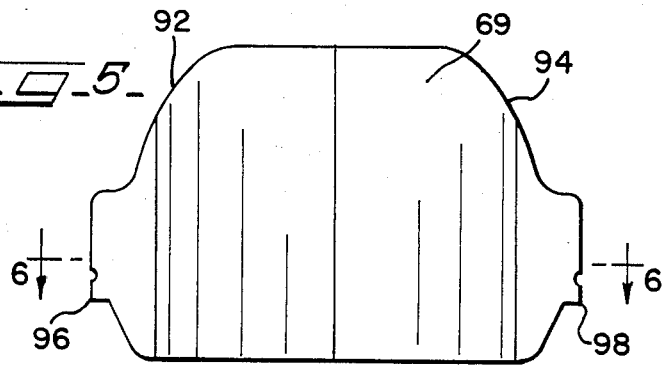
FIG. 5 is a front view of a wedge shim.

For a more detailed view of the wedge shim 69, FIGS. 5–6 are now referred to. A front view of shim 69 is shown in FIG. 5. Shim 69 is of a generally rectangular shape, with upper corners 92, 94 rounded and tabs 96, 98 extending from both sides. As shown in FIG. 2, rear surface 74 is sloped outwardly from bottom to top to provide the wedging effect. In FIG. 6, a cross section of shim 69 is shown. Rear surface 74 is generally flat. Generally flat surfaces 78 and 79 comprise each half of the front face of shim 69. Such faces are joined at a center vertical axis at an angle of from 140° to 180° to form a concave face of shim 69. Alternatively, this arrangement could be described by stating that surfaces 78 and 79 each extend at an angle of from 0° to 20° from a transverse plane containing said center axis and parallel to the longitudinal center line of shim 69.

Figure 7:
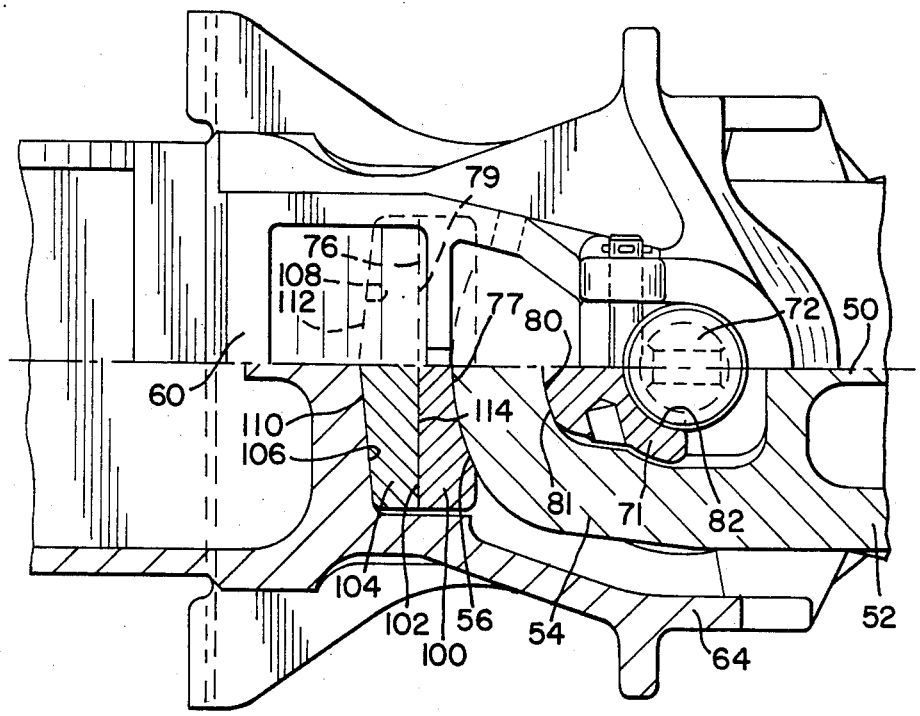
FIG. 7 is a top view in partial cross section of an articulated connection showing an alternative shim-follower block interface and alternate shim pocket wall interface.

In the alternative embodiment of the articulated connection of the present invention shown in FIG. 7, elements similar to FIG. 1 are numbered identically. However, follower block 100 has a flat rear surface 102. Shim 104 has a flat front surface 114 abutting the rear surface 102 of follower block 100. Female connecting member 60 has a cavity rear surface comprising two flat surfaces 106 and 108 joined at center vertical axis at an angle of from 140° to 180° to form a concave face of the cavity. The rear surface of shim 104 comprises two flat surfaces 110 and 112 joined at a center vertical axis at an angle of from 140° to 180° to form a convex face of shim 104. The convex face of shim 104 and the concave face of the cavity abut to keep the shim in generally vertical alignment and orientation within the cavity.

What is claimed is:

1. A coupler arrangement for adjacent ends of railway cars comprising, a female member having top, bottom and side walls forming an open cavity therein, said top and bottom walls having vertically aligned holes therein, a male member having an arcuate end surface with a vertical hole near said end, said male member fitting within said cavity, a pin means extending through the vertically aligned holes in the female and the male member thereby pivotally connecting said female and said male members, a pin bearing block located between said pin means and the hole in the male member, a follower block having a front arcuate surface abutting the arcuate end surface of said male member and a rear surface conprising two generally planar surfaces joined along a centrally located vertical axis, said planar surfaces extending from said vertical axis at angles of 0°-20° from the horizontal to form a convex arrangement, and a shim member having a sloped rear surface abutting a sloped interior wall of the female member cavity and a front surface abutting the rear surface of the follower block, the shim member front surface comprising two generally planar surfaces joined along a centrally located vertical axis, said planar surfaces extending from said vertical axis at angles of 0°-20° from the horizontal to form a concave arrangement complementary to the convex arrangement of the rear surface of the follower block.

2. An articulated railway coupler arrangement comprising, a male member inserted into a female member, said male member and female member having vertically aligned holes, a pin extending through said vertically aligned holes to join said male member with said female member, a shim member having a sloped generally convex rear surface abutting a sloped generally concave rear wall of a cavity in said female member and a generally flat front surface, said shim rear convex surface comprising two generally planar surfaces joined at a vertical center axis, said rear concave wall of said female member cavity comprising two generally planar walls joined at a vertical center axis, said shim rear convex surface and said female member cavity rear concave wall being complementary, and a follower block having a generally flat rear surface abutting the front flat surface of said shim member and an arcuate concave front surface abutting the arcuate convex end of said male member.

* * * * *